US005704883A

United States Patent [19]

Eckmann

[11] Patent Number: 5,704,883

[45] Date of Patent: Jan. 6, 1998

[54] HAND AND WRIST WEIGHT ASSEMBLY

[75] Inventor: James A. Eckmann, Lake County, Ill.

[73] Assignee: Sportworks, Ltd., Vernon Hills, Ill.

[21] Appl. No.: 746,852

[22] Filed: Nov. 18, 1996

[51] Int. Cl.[6] ..... A63B 21/065

[52] U.S. Cl. ..... 482/105; 482/139

[58] Field of Search ..... 482/105, 50, 139

[56] References Cited

U.S. PATENT DOCUMENTS

| | | | |
|---|---|---|---|
| D. 200,415 | 2/1965 | Tarbox . | |
| D. 370,510 | 6/1996 | Kissin et al. . | |
| 4,247,097 | 1/1981 | Schwartz | 482/105 |
| 4,330,120 | 5/1982 | Netti . | |
| 4,556,215 | 12/1985 | Tarbox et al. . | |
| 4,575,075 | 3/1986 | Tarbox et al. . | |
| 4,585,228 | 4/1986 | Olson . | |
| 4,756,525 | 7/1988 | Whitsitt | 482/105 |
| 4,813,079 | 3/1989 | Reitzel . | |
| 4,923,418 | 5/1990 | Hoffman . | |
| 5,004,227 | 4/1991 | Hoffman . | |

*Primary Examiner*—Lynne A. Reichard

*Attorney, Agent, or Firm*—Polster, Lieder, Woodruff & Lucchesi, L.C.

[57] ABSTRACT

A hand and wrist weight assembly has a web with a finger-receiving part, a back section on which a hand weight is mounted along the back of the user's hand, and a wrist section on which a wrist weight, independent of the hand weight and spaced from the hand weight is mounted along the back of the user's wrist. The wrist section has a strap for retaining the assembly on the user's arm. The back section and wrist section are flexible both transversely and longitudinally to permit flexing of the user's wrist while the assembly is in place, and conformance to a part of the user's hand and wrist over which the back section and the wrist section extend. The hand weight and the wrist weight are both soft and complaint to the extend that they will conform to the contours of the back of the hand and the wrist. The wrist weight can take the form of one or more elongated, transversely extending, particle-filled pouches, secured to the wrist section of the web.

14 Claims, 5 Drawing Sheets

HAND AND WRIST WEIGHT ASSEMBLY

STATEMENT REGARDING FEDERALLY SPONSORED RESEARCH OR DEVELOPMENT

Not Applicable.

CROSS-REFERENCE TO RELATED APPLICATIONS

This application is a companion application to a design application being filed concurrently herewith.

BACKGROUND OF THE INVENTION

Finger-receiving glove-type weights are well known. A review of patents for typical hand weights is set out in U.S. Pat. No. 4,330,120.

One of the objects of this invention is to provide a hand and wrist weight that is economical to produce, comfortable to wear, which leaves the palm free, and is less tiring than weights known heretofore.

Other objects will become apparent to those skilled in the art in the light of the following description and accompanying drawings.

BRIEF SUMMARY OF THE INVENTION

In accordance with this invention, generally stated, a hand and wrist weight assembly is provided with a web with a back web section that spans the back of the hand of the user and integral with the back section, a wrist section that extends along and part way around the wrist of the user. A hand weight is mounted on the web back section along the back of a user's hand, and a wrist weight is mounted on the web transversely of the wrist section of the web. Both of the weights are flexible in the sense of conforming to a part of the user's hand and wrist. The hand weight and wrist weight are separated by a portion of the web which is flexible and light, so that the wrist and hand can be flexed with respect to one another.

The hand weight and the wrist weight are made in the form of pouches filled with heavy particles. The hand weight is preferably formed with stitching roughly parallel with the fingers of a user, in lines parallel with one another and spaced both from one another and from the edges of the pouch, so as to hold the particles against shifting, but to allow communication of the particles around the perimeter of the weight pouch.

The wrist weight can be made in the form of two or more sections, parallel with one another and separated by a line of stitching between each successive one, to provide a greater amount of wrist weight.

A strap is secured at one end of the wrist weight, and a loop buckle, at the other end. The strap is preferably made with a section of loop material at a free end, and a strip of hook material secured to the wrist weight, so that the free end of the strap can be passed through the buckle and looped back to engage the hook part.

The web has finger holes and a thumb hole and, in the preferred embodiment, has a binding extending all along its perimeter. The weights, also, are preferable bound at their outer edges.

DETAILED DESCRIPTION OF THE INVENTION

Figure 1:
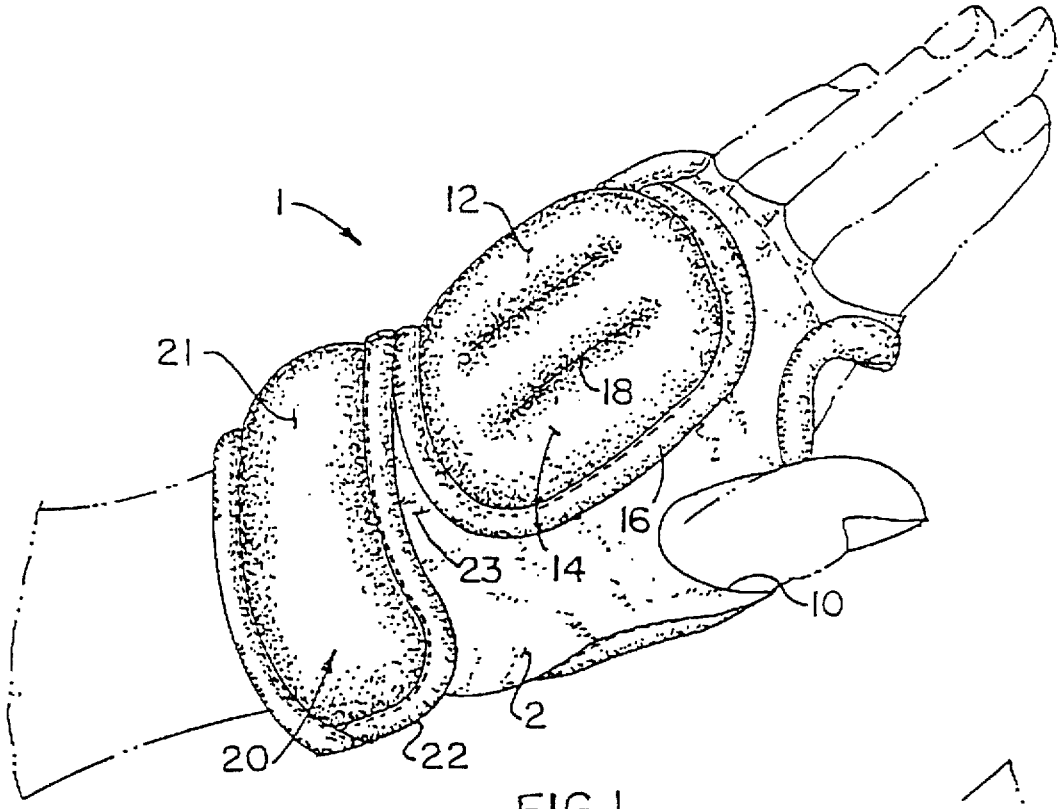
FIG. 1 is a view in perspective, from the wrist toward the fingers of a user, of one embodiment of this invention in use.
Figure 2:
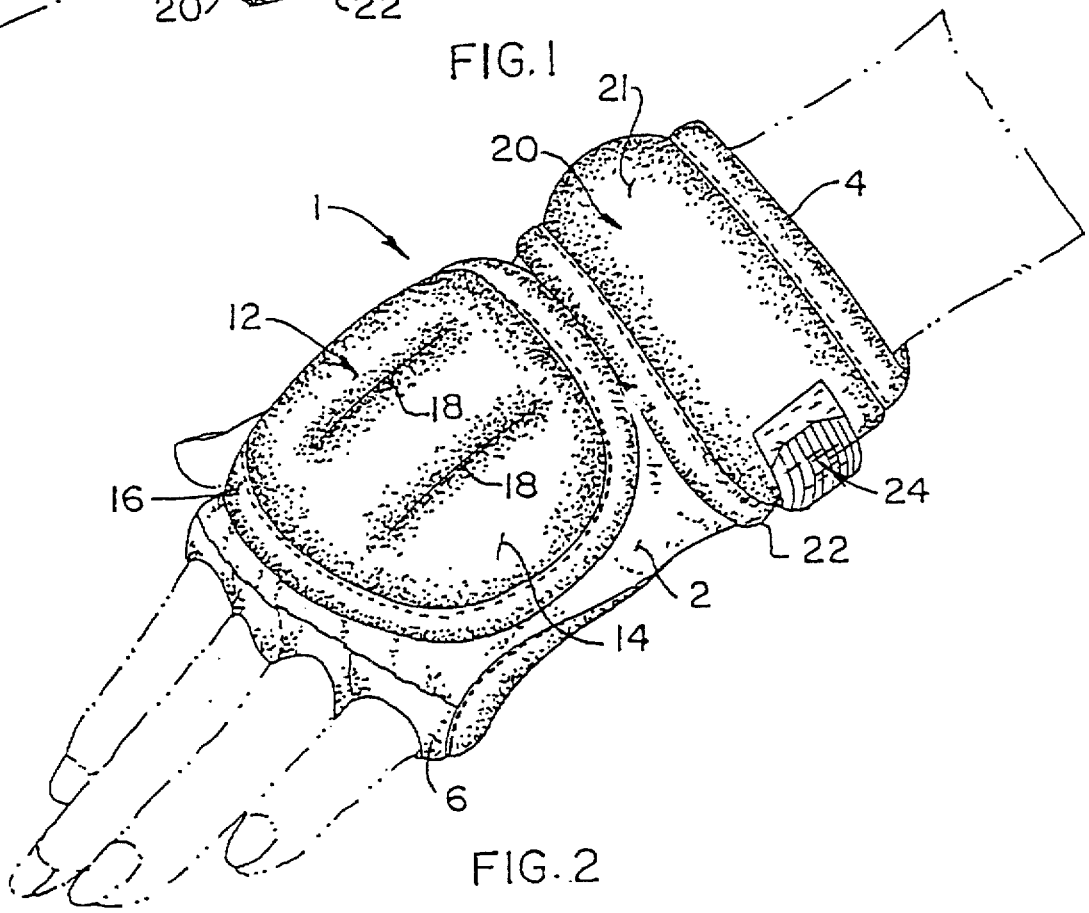
FIG. 2 is a view in perspective from the opposite direction.
Figure 3:
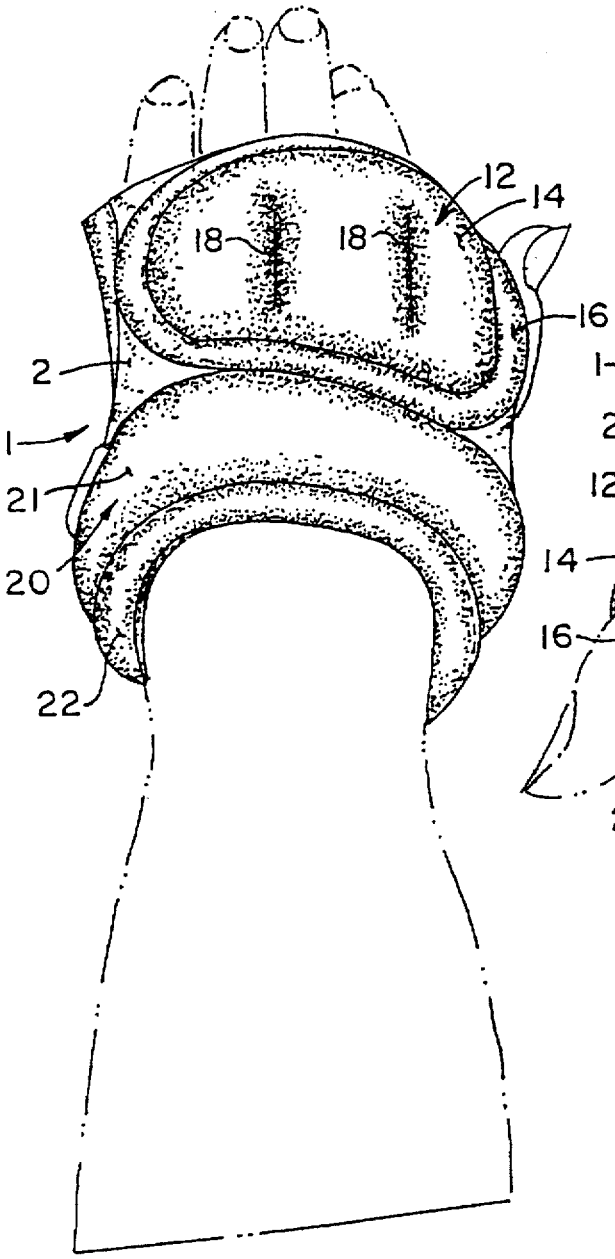
FIG. 3 is another view in perspective of the device shown in FIGS. 1 and 2.
Figure 4:
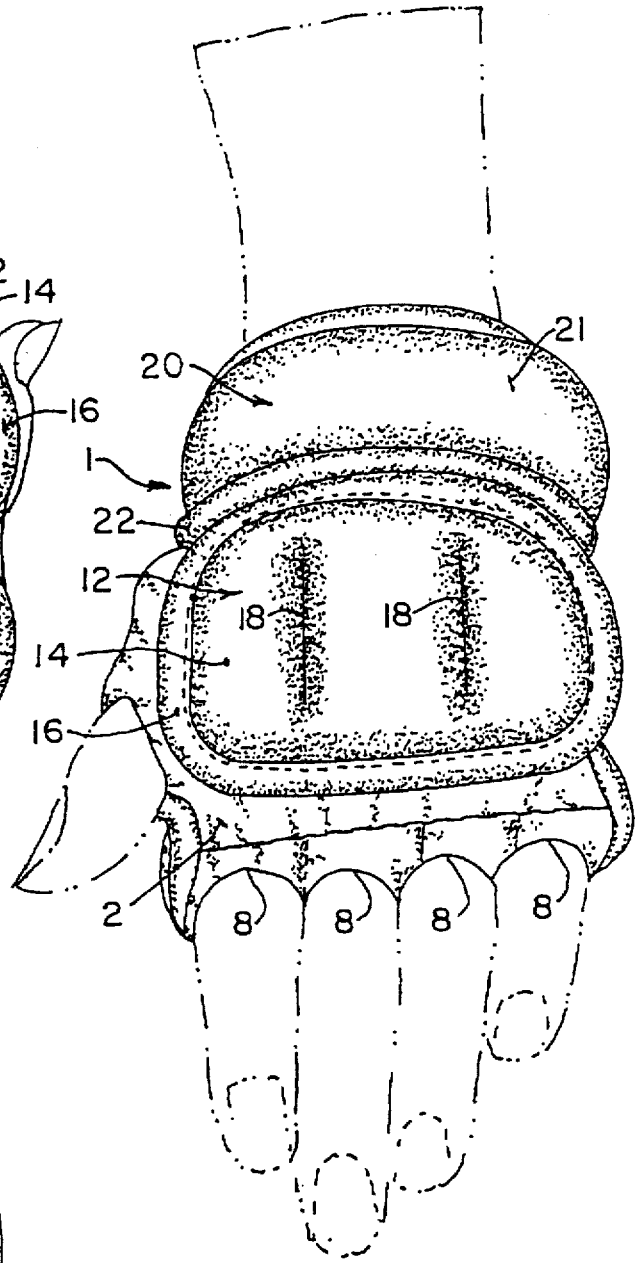
FIG. 4 is a view in the opposite direction from FIG. 3.
Figure 5:
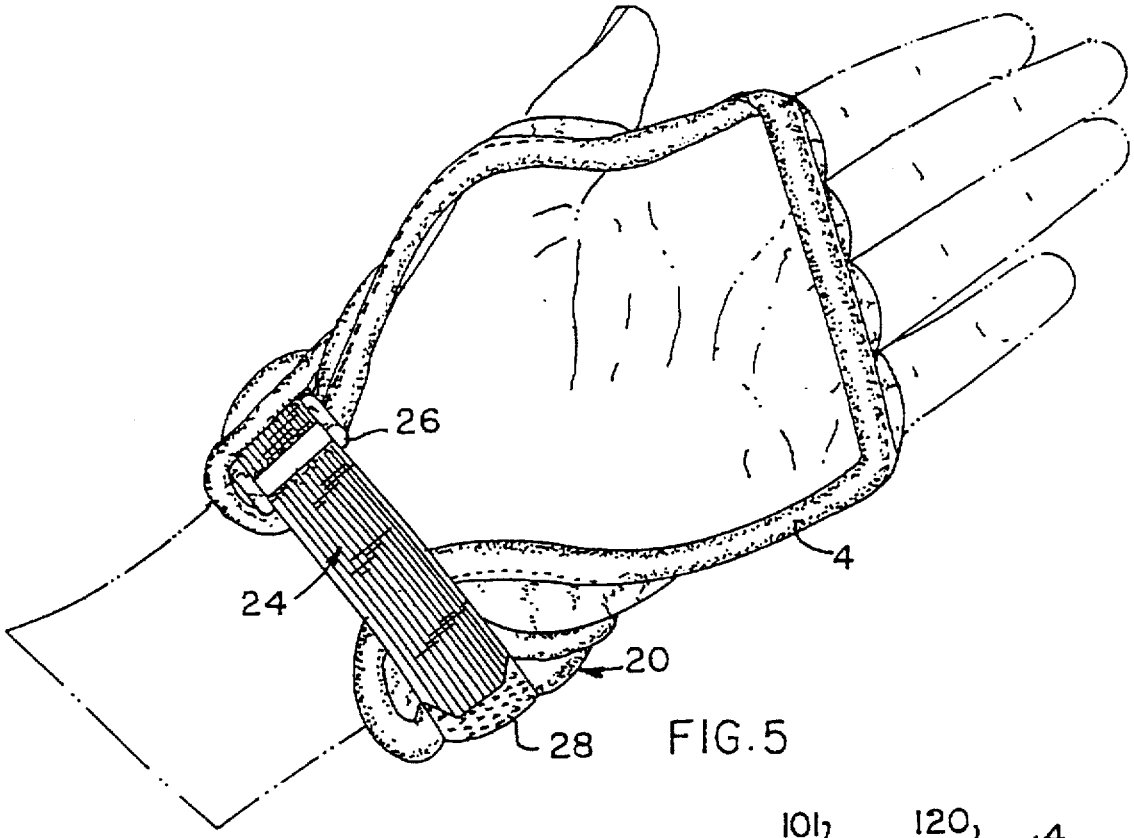
FIG. 5 is a view in perspective of the palm side of the weights shown in FIGS. 1–4.

Referring now to FIGS. 1–4, 8 and 9, reference numeral 1 indicates a hand and wrist weight assembly of this invention. The weight assembly 1 has a web 2, which in this embodiment, is made of two sheets of woven nylon fabric, between which a layer of Neoprene is bonded, to form a soft web, flexible in every direction. As shown particularly in FIGS. 8 and 9, the web is bound with bias tape around its perimeter 4. A reinforced finger area 6 contains finger holes 8. A thumb hole 10 is provided in the web at the appropriate position. As shown in FIGS. 5 through 9, the finger area 6 is immediately adjacent the perimeter 4, and the finger holes 8 and thumb hole 10 are close to the perimeter 4.

Figure 9:
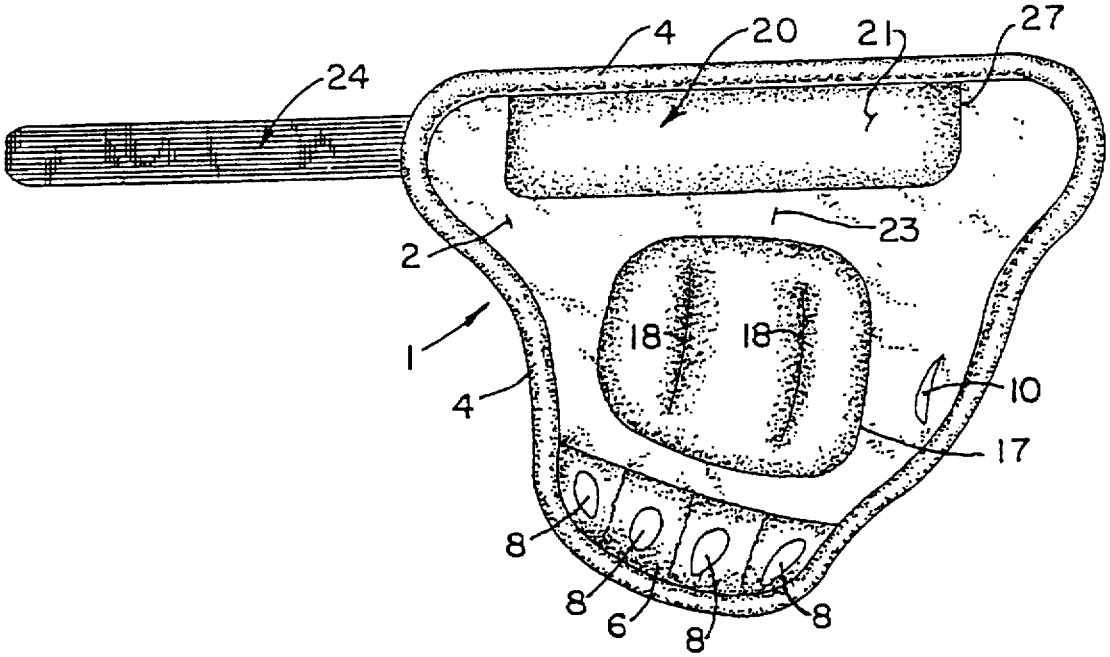
FIG. 9 is a bottom plan view of the device shown in FIG. 8.

A hand weight 12 is secured to the outside of the section of the web that extends over the back of the hand. The weight 12 is made up of a pouch 14 filled with flattened, generally circular iron particles or pellets with an outside diameter of around 0.128 to 0.044 inches and a thickness between 0.02 and 0.035 inches. The pouch 14 can be made of the same material as the web 2, and is secured to the web by stitching both around the perimeter of the pouch, as indicated in FIG. 9, and by lines of stitching 18, which are spaced, parallel to another and roughly parallel to the direction of fingers of the hand of the user. The stitching 18 is spaced from the outer margins of the pouch 14 a substantial distance, which permits movement of the particles inside the pouch around the edges, so that the pouch can adapt readily to the contours to the back of the hand of the user, and facilitates filling of the pouch. The pouch 14 also has bound edges 16, bound with bias tape. In making the weight, the pouch is put in place, the parallel line of stitching put in and the pouch sewn around its edge except for a gap through which the pellets are introduced. After the pellets are in place, the gap is closed by stitching and any remaining stitching done.

Figure 8:
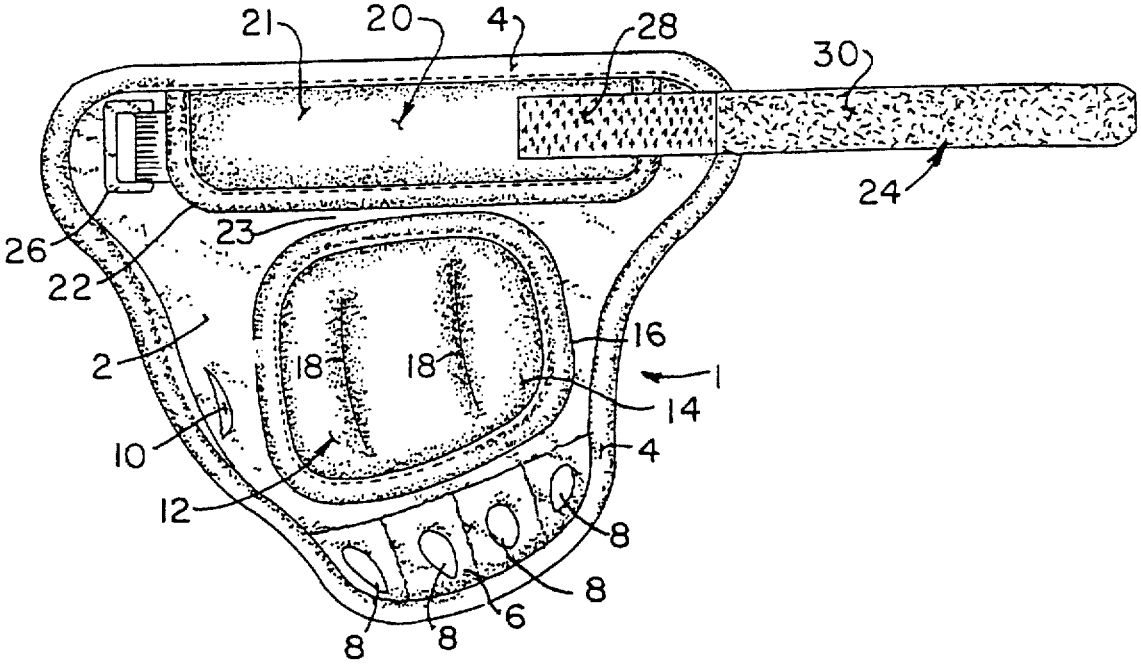
FIG. 8 is a top plan view of the device shown in FIGS. 1–4.

A wrist weight 20 is secured to the wrist section of the web 2, spaced in the direction of the user's elbow from the hand weight 12 and extending transversely of the wrist of the user. The weight 20, like the hand weight 12, is covered with the same material as the web 2. It is in the form of a pouch 21, filled with the same kinds of pellets as the hand weight 12, and bound with bias tape that extends from the binding of the web 2 around the edge of the pouch 21 nearest the pouch 14 as shown in FIG. 8. The wrist weight 20 is spaced sufficiently from the hand weight 12 to leave a hinging area 23, which permits the web to flex between the hand weight 12 and the wrist weight 20. The wrist weight is constructed and filled similarly to the hand weight.

Figure 6:
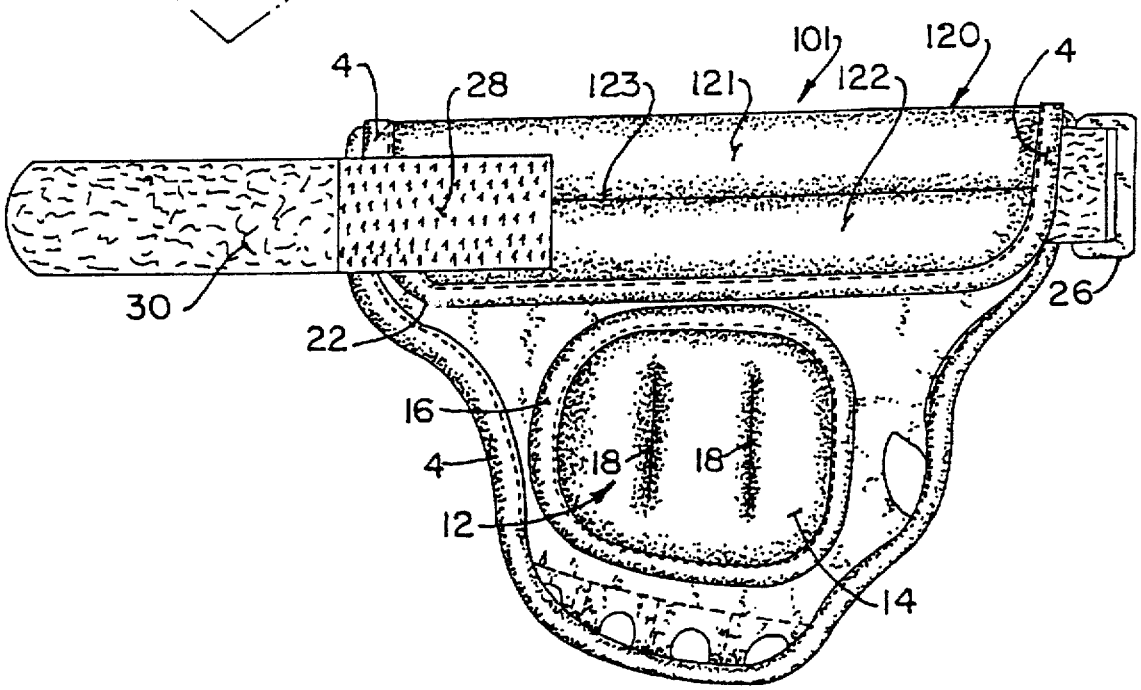
FIG. 6 is a top plan view of a second embodiment of a hand and wrist weight of this invention.
Figure 7:
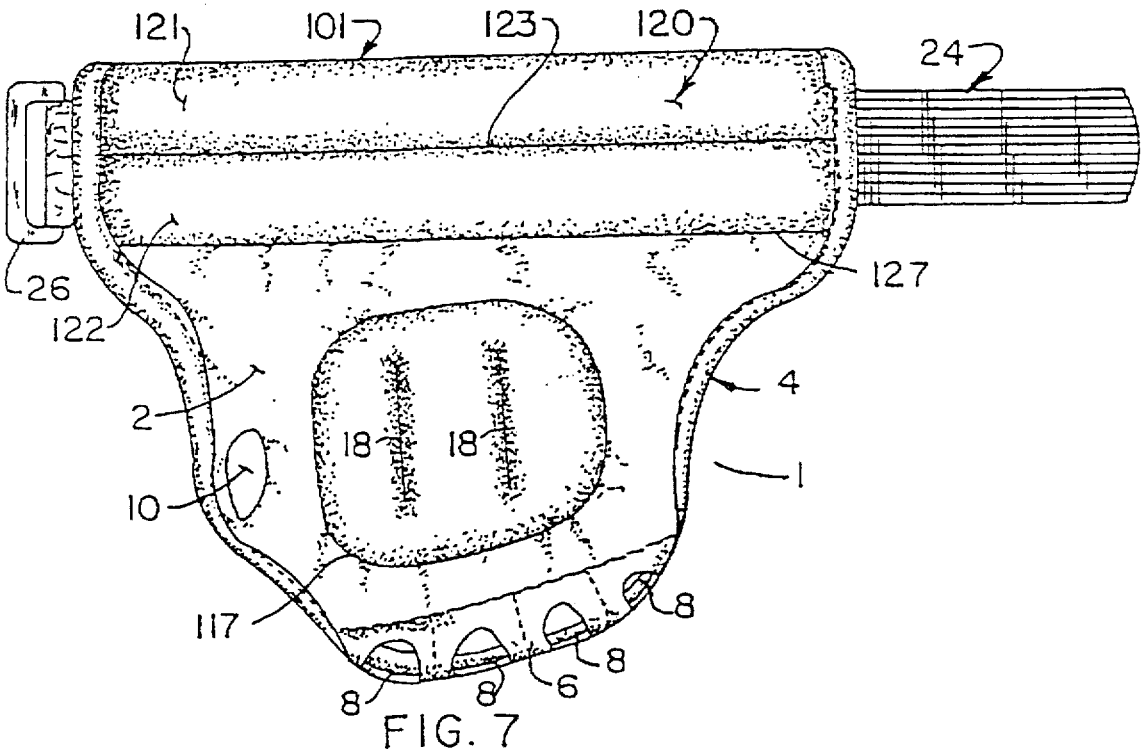
FIG. 7 is a bottom plan view of the device shown in FIG. 6.

Referring now to FIGS. 6 and 7 for a second embodiment of hand and wrist weight assembly 101, the construction of the weight that covers the back of the hand is identical with that of the first embodiment described. In this second embodiment, however, the web is made longer in the direction away from the finger holes, to the point at which it can be folded back over the outside of the wrist web, to form pouches of a wrist weight 120. Wrist weight 120 is made of two separate pouches, an upper pouch 122 and a lower pouch 121, separated by a line of stitching 123.

In this embodiment, the binding of the web extends continuously around the web, and around three sides of the perimeter of the weight 120. The pouches 121 and 122 are longer than the pouch 21 of the first embodiment, and therefore, in total, have a greater amount of weight. In the embodiment shown, a single large pouch is formed, with a gap through which the iron pellets are introduced, and after the pellets are in place, and the gap closed, the central line of stitching is made.

In both embodiments, a strap 24 is provided, secured to the wrist portion of the web, or to the top (outside) surface of the wrist weight at one end of the wrist weight as shown in FIGS. 6 and 8. The strap 24 has a free end with a loop area 30, and inboard of the loop area, a hook area 28. At the other end of the weight, a strap is provided with a loop buckle 26. In mounting the device of either embodiment, the fingers and thumb are put through the appropriate holes, the web is pulled down until the strap 24 will embrace the wrist, the free end of the strap is run between an inside surface of the buckle 26 and a loop of the strap which holds it, tamed back and pulled snugly, at which time the loop area is put into contact with the hook area to hold the strap securely in place.

As can be seen from the inner or "skin" side views 9 and 7, the stitching 17 and 27 and 117 and 127 goes completely through the web, and, along the edges of the wrist weights can serve to secure the binding tape as well. As is evident from FIG. 5, the perimeter 4 of the web frames the palm of a user, but does not cover the palm from the wrist strap 24 to the portion of the perimetric binding that crosses the hand at the base of the fingers, leaving the palm free to grasp the handle of a NordicTrack type exercise machine, for example, or any other article, and permitting the palm to stay cool as compared with its condition in a weight in which the palm is covered in whole or in part.

Numerous variation in the construction of the hand and wrist weight assembly of this invention within the scope of the appended claims, will occur to those skilled in the art in the light of the foregoing disclosure. Merely by way of example, the numbers of pouches making up the wrist weight can be increased. The numbers of lines of stitching 18 can be increased or decreased, and similar lines of stitching can be provided in the wrist weight pouches. Other particulate matter can be used as the weight, as long as the matter is non-toxic and the weights themselves remain soft and pliable, conforming to the contour of the wrist and hand. These are merely illustrative.

I claim:

1. A hand and wrist weight assembly to be mounted on the back of the hand and wrist of a human user, said assembly comprising a web having a margin extending substantially uninterruptedly entirely around it, finger-receiving openings in a finger area contiguous a portion of said web, said openings being adjacent said margin in said finger area, a back section on which soft, compliant hand weight means is mounted, and a wrist section on which soft, compliant wrist weight means, independent of said hand weight means and spaced from said hand weight means, is mounted, said wrist section having a wrist strap for embracing a wrist of a user, said back section and wrist section being flexible both transversely and longitudinally, said web margin defining an uninterruptedly open palm section between said strap and said finger area.

2. The hand and wrist weight assembly of claim 1 wherein said wrist weight means comprises a plurality of separate weight members extending transversely of a user's wrist.

3. The hand and wrist weight assembly of claim 2 wherein each of said plurality of separate weight members is flexible in a direction transverse of a user's wrist and conforms to a part of said user's wrist over which said weight members extend.

4. The hand and wrist weight assembly of claim 2 wherein the hand weight means is about one half pound, and each of said wrist weight members is about one half pound.

5. The hand and wrist weight assembly of claim 1 wherein said wrist weight means is elongated in a direction transverse of a user's wrist, and conforms to a part of a user's wrist over which it extends.

6. The hand and wrist weight assembly of claim 5 wherein said wrist weight means comprises particulate matter in a flexible pouch.

7. The hand and wrist weight assembly of claim 6 wherein the particulate matter in both said hand weight means and said wrist weight means comprises iron pellets about 0.128"–0.044" in diameter and between 0.02" and 0.035" in thickness.

8. The hand and wrist weight assembly of claim 1 wherein said hand weight means comprises particulate matter in a flexible pouch.

9. The hand and wrist weight assembly of claim 8 wherein said pouch has at least two rows of stitching through it intermediate opposite edges of said pouch but short of said edges.

10. The hand and wrist weight assembly of claim 9 wherein said stitching is in parallel rows, in a direction lengthwise of the arm of a user.

11. The hand and wrist weight assembly of claim 8 wherein the particulate matter in both said hand weight means and said wrist weight means comprises iron pellets about 0.128"–0.044" in diameter and between 0.02" and 0.035" in thickness.

12. The hand and wrist weight assembly of claim 1 wherein said hand weight weighs about one half pound and said wrist weight means weighs about one half pound.

13. A hand and wrist weight assembly to be mounted on the back of the hand and wrist of a human user, said assembly comprising a finger-receiving web having a back section on which soft, compliant hand weight means is mounted, and a wrist section on which soft, compliant wrist weight means, independent of said hand weight means and spaced from said hand weight means, is mounted, said wrist section having means for retaining said assembly on a user's arm, said back section and wrist section being flexible both transversely and longitudinally, said wrist weight means comprising a plurality of separate weight members extending transversely of a user's wrist, said wrist section of said web being long and folded back over the outer surface of said web to form pouches of said plurality of wrist weight means.

14. The hand and wrist weight assembly of claim 13 wherein a binding extends around the entire perimeter of the web, and across a long edge of said wrist weight closest to said hand weight.

* * * * *